US007625240B2

(12) United States Patent
Hayden, Sr. et al.

(10) Patent No.: US 7,625,240 B2
(45) Date of Patent: Dec. 1, 2009

(54) RECEPTACLE CONNECTOR

(75) Inventors: Perry L. Hayden, Sr., Salinas, CA (US); Peter Lum, Palo Alto, CA (US); William F. Edwards, Jr., Livermore, CA (US); Flintstone Yu, Fremont, CA (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 11/977,917

(22) Filed: Oct. 26, 2007

(65) Prior Publication Data

US 2009/0111304 A1 Apr. 30, 2009

(51) Int. Cl.
*H01R 24/00* (2006.01)

(52) U.S. Cl. ..... 439/637

(58) Field of Classification Search ..... 439/637, 439/271, 680, 540.1, 541, 260, 246, 283
See application file for complete search history.

(56) References Cited

U.S. PATENT DOCUMENTS

| | | | | |
|---|---|---|---|---|
| 5,928,029 | A * | 7/1999 | Lam | 439/497 |
| 6,352,442 | B1 * | 3/2002 | Kudo | 439/260 |
| 6,431,897 | B1 * | 8/2002 | Hashiguchi et al. | 439/267 |
| 6,533,606 | B2 * | 3/2003 | Yamane | 439/495 |
| 7,311,542 | B2 * | 12/2007 | Suzuki | 439/260 |
| 7,316,590 | B2 * | 1/2008 | Zueck et al. | 439/681 |
| 7,344,409 | B2 * | 3/2008 | Lang et al. | 439/607 |
| 2004/0047564 | A1 * | 3/2004 | Chiu et al. | 385/53 |
| 2006/0009080 | A1 * | 1/2006 | Regnier et al. | 439/637 |

* cited by examiner

*Primary Examiner*—Alexander Gilman
(74) *Attorney, Agent, or Firm*—Edell, Shapiro & Finnan LLC

(57) ABSTRACT

A connector comprising an insulating body defining a slot that is adapted to receive a pluggable module. A plurality of conductive pins extend into the slot and at least one extension, coupled to the insulating body, protects the plurality of pins from being shorted by an incorrectly inserted pluggable module.

8 Claims, 5 Drawing Sheets

RECEPTACLE CONNECTOR

FIELD OF THE INVENTION

The present disclosure generally relates to connectors. More specifically, the present disclosure relates to a connector for electrical signals.

BACKGROUND

A hot-swappable, plug and play, single-port SFP (Small Form-factor Pluggable) module is used in network devices implementing Gigabit over fiber applications. The SFP module offers several significant advantages over its predecessor, the GBIC (Gigabit Interface Converter) such as lower cost, lower power consumption, and smaller size. Thus, with the SFP form factor, fiber Gigabit systems may be developed featuring similar port densities as copper-only systems using RJ-45 connectors.

The SFP module is electrically connected to an electronic apparatus by inserting the SFP module into a receptacle connector of the electronic apparatus. The receptacle connector is situated in an opening of the electronic apparatus. The receptacle connector comprises an insulating body and a plurality of pins, in which the pins are respectively disposed in pin channels of the insulating body. Each of the pins has a contact tab extending into a card slot of the insulating body. A solder tab extends from each pin to an external side of the insulating body and is soldered onto a circuit board of the electronic apparatus. When the SFP module is normally or correctly inserted into the opening of the electronic apparatus to interface with the receptacle connector. An edge of a circuit card of the SFP module comprises a plurality of plated traces that are aligned with the pins of the receptacle connector. To achieve an electrical connection, the edge of the circuit card of the SFP module is inserted into the card slot of the receptacle connector.

BRIEF DESCRIPTION OF THE DRAWINGS

The accompanying drawings are included to provide a further understanding of embodiments of the invention, and are incorporated in and constitute a part of this specification. The drawings illustrate at least one embodiment of the invention and, together with the description, serve to explain the principles of the invention.

DESCRIPTION OF EXAMPLE EMBODIMENTS

Overview

One embodiment of the present invention comprises a connector comprising an insulating body defining a slot adapted to receive a pluggable module. A plurality of conductive pins extend into the slot and, at least one extension is coupled to the insulating body such that the extension protects the plurality of pins from being shorted by an incorrectly inserted pluggable module.

DETAILED DESCRIPTION

Embodiments of the present invention provide a receptacle connector that prevents shorting or grounding of pins during incorrect (e.g., upside-down) insertion of a pluggable module (such as an SFP module) into the receptacle connector.

Figure 1:
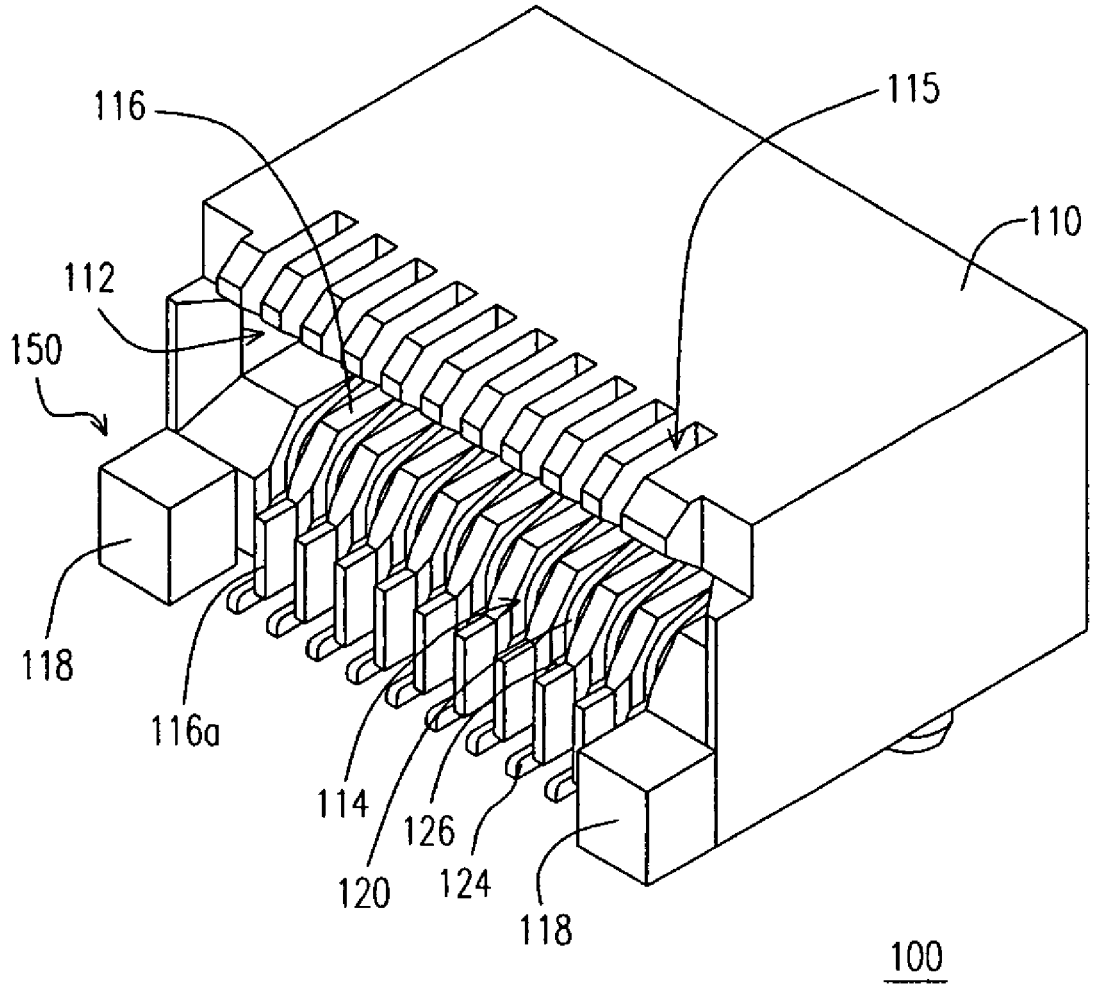
FIG. 1 illustrates an isometric view of an example receptacle connector according to an embodiment of the present invention.
Figure 2:
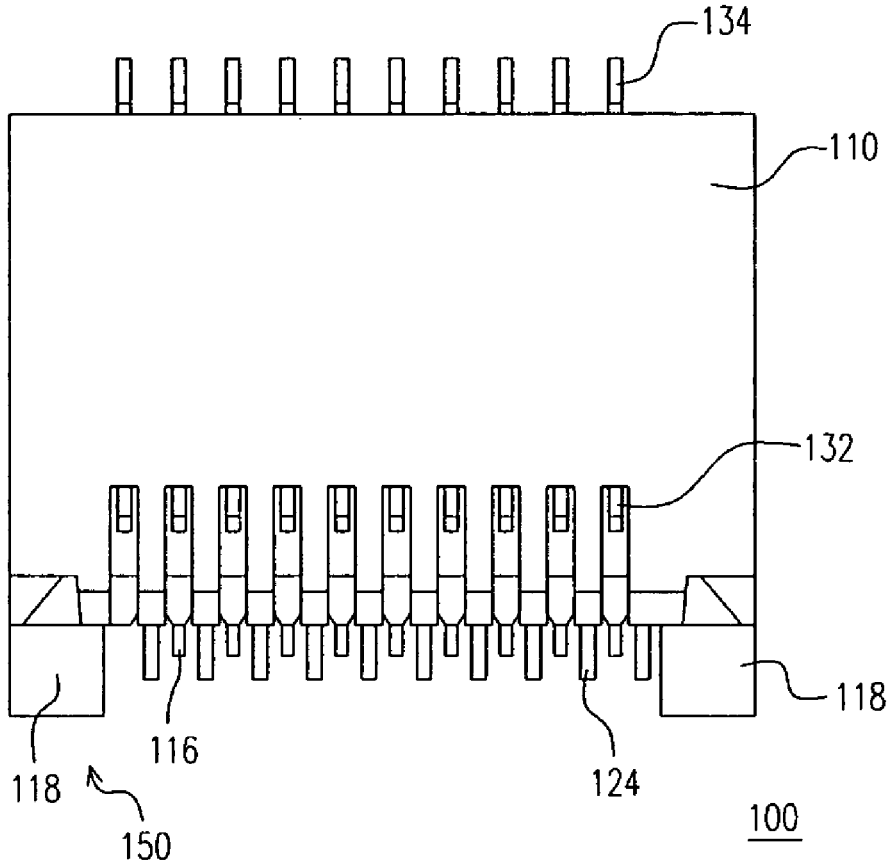
FIG. 2 illustrates a top view of the example receptacle connector shown in FIG. 1.
Figure 3:
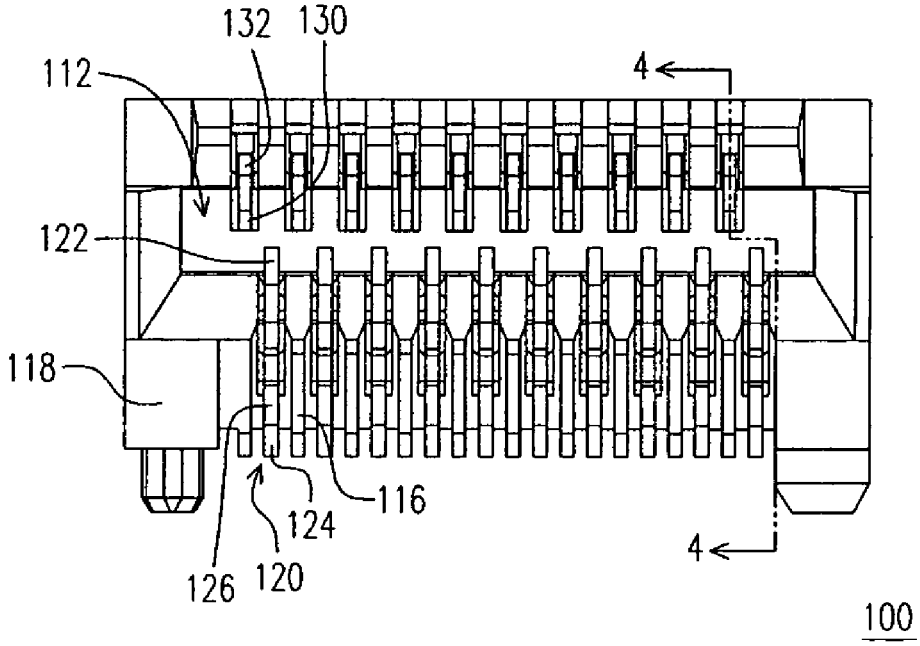
FIG. 3 illustrates a front view of the example receptacle connector shown in FIG. 1.
Figure 4:
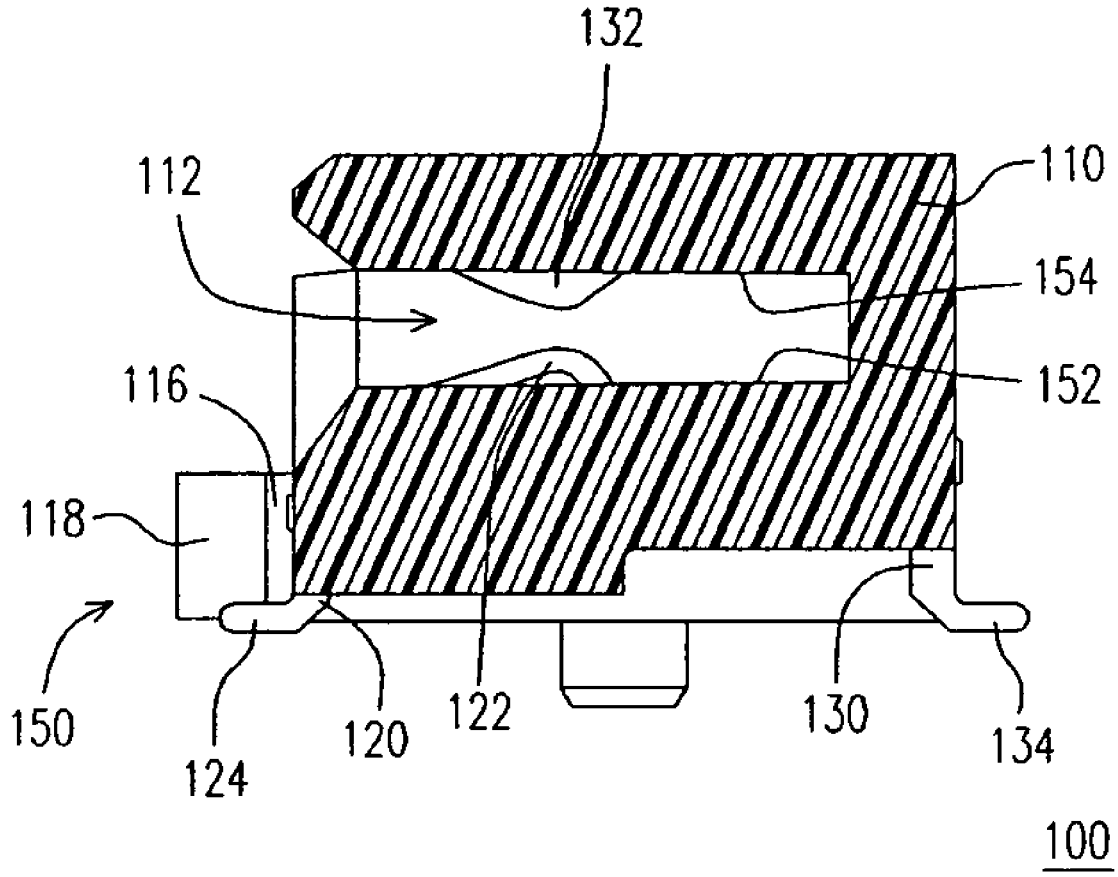
FIG. 4 illustrates a cross-sectional view taken along line 4-4 of the example receptacle connector shown in FIG. 3.

FIG. 1 illustrates an example of an isometric view of a receptacle connector according to an embodiment of the present invention, FIG. 2 is a top view of the receptacle connector shown in FIG. 1, FIG. 3 illustrates a front view of the receptacle connector shown in FIG. 1, and FIG. 4 illustrates a sectional view taken along line 4-4 of the receptacle connector of FIG. 3.

Referring to FIG. 1-4, the receptacle connector 100, according to one embodiment of the present invention, comprises an insulating body 110. The insulating body 110 comprises a card slot 112 and a plurality of first pin channels 114. In addition, the receptacle connector 100 comprises a plurality of first pins 120, which are respectively disposed in the first pin channels 114. Each of the first pins 120 comprises a first contact tab 122 extending into the card slot 112 from a first side 152 thereof. Each of the first pins 120 further comprises a first solder tab 124 extending beyond a vertical side of the insulating body 110 to be soldered onto a surface of a circuit board when mounting the connector 100. In accordance with one embodiment of the invention, the first pins 120 are protected from shorting when a pluggable module is incorrectly inserted into the connector through use of an extension 150 that comprises at least one of ribs 116 or posts 118 as described in detail below.

The insulating body 110 may further comprise a plurality of second pin channels 115, and the receptacle connector 100 further comprises a plurality of second pins 130 which are respectively disposed in the second pin channels 115. Each of the second pins 130 comprises a second contact tab 132 extending into the card slot 112 from a second side 154 thereof. Each of the second pins 130 further comprises a second solder tab 134 extending to the external side of the bottom of the insulating body 110 to be soldered onto a surface of the circuit board.

According to an embodiment of the present invention, the receptacle connector comprises a plurality of alternately arranged insulating spacers 116 between the first pin channels 114 such that one of the insulating spacers 116 is disposed between two adjacent first pin channels 114. Each insulating spacer comprises an insulating rib **116*a* that substantially protrudes beyond a vertical surface 126 of the first pins 120. A protruding direction of the insulating ribs 116*a* is substantially parallel and opposite to an inserting direction of the card slot 112. According to an embodiment of the present invention, the insulating ribs 116*a* may be integrally formed with the insulating spacers 116, and may be simultaneously formed with the insulating spacers 116**.

According to an embodiment of the present invention, the insulating body 110 comprises a pair of insulating posts 118, which are respectively disposed at two lateral ends thereof. According to an embodiment of the present invention, the two insulating posts 118 are respectively disposed at two lateral ends of a bottom side of the insulating body 110 adjacent to the card slot 112. The insulating posts substantially extend beyond the first solder tabs 124. The extending direction of the insulating posts 118 is substantially parallel and opposite to the inserting direction of the card slot 112.

Figure 5:
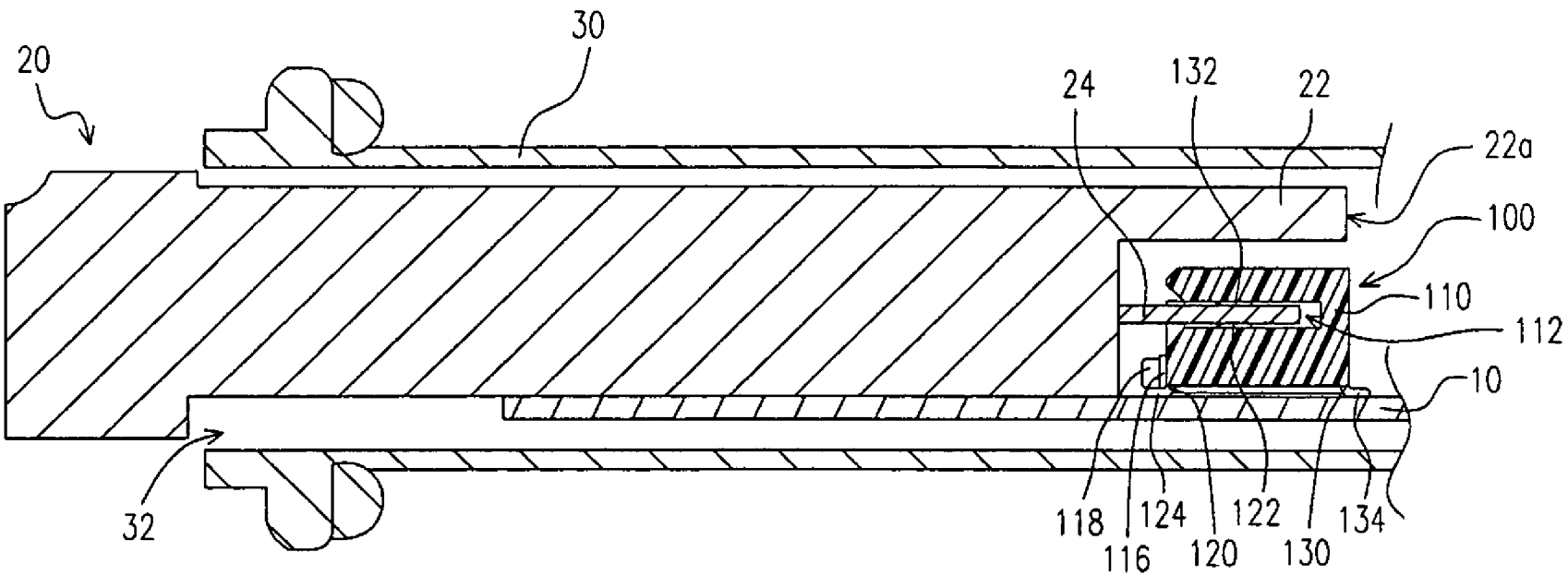
FIG. 5 illustrates while a pluggable module is being correctly inserted into the example receptacle connector shown in FIG. 1.

Referring to FIG. 5, the receptacle connector 100 is mounted on a circuit board 10 by soldering the solder tabs 124 and 134 to traces on the circuit board 10. A pluggable module 20 is normally or correctly inserted into an opening 32 of a housing 30 and is electrically connected to a circuit board 10 through the receptacle connector 100. When the pluggable module 20 is normally or correctly inserted into the opening 32 of the housing 30, the card 24 of the pluggable module 20 is inserted into the card slot 112. The first contact tab 122 and/or second contact tab 132 slideably and conductively couples to the card 24. The surface 22*a* of the conductive body 22 of the pluggable module 20 is positioned above the receptacle connector 100 and does not come in direct contact with the first solder tabs 124 or the first pins 120. The pluggable module 20 is, for example, a SFP module.

Figure 6:
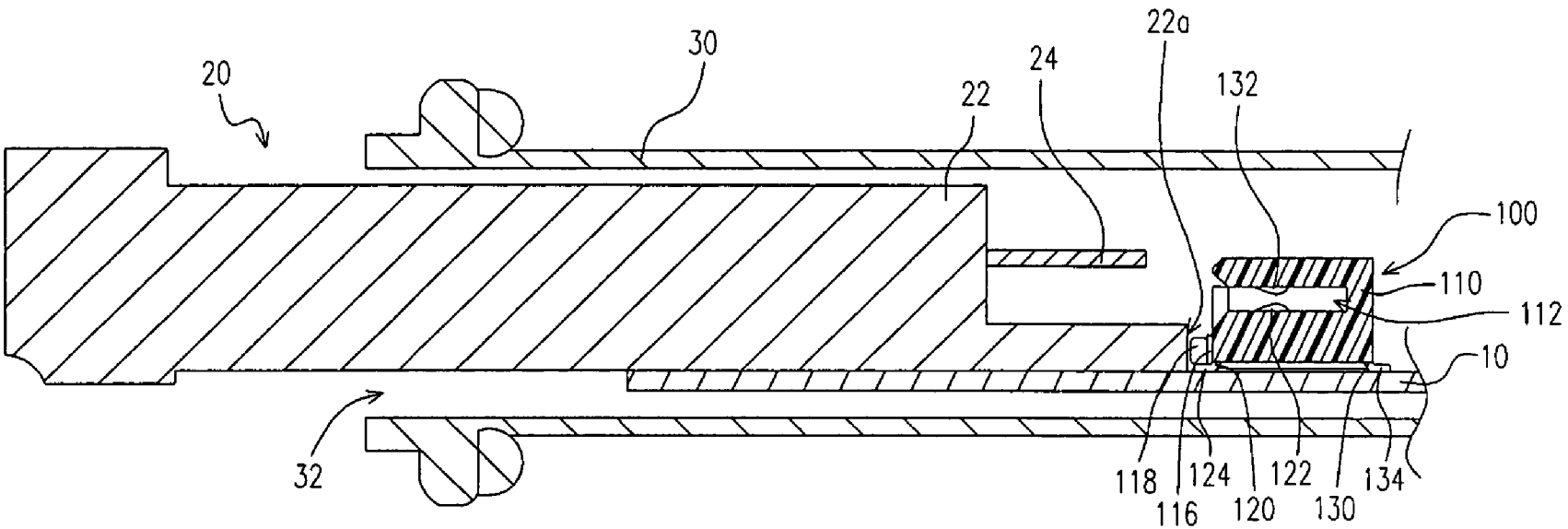
FIG. 6 illustrates while the pluggable module is being inserted upside-down into the example receptacle connector shown in FIG. 1.

Referring to FIG. 6, according to an embodiment of the present invention, when the pluggable module 20 is incorrectly inserted or inserted upside-down into the opening 32 of the housing 30, the insulating ribs 116*a* prevent the surface 22*a* of the pluggable module 20 from simultaneously contacting the vertical surface 126 of one or more adjacent first pins 120 and thereby prevent a short circuit. According to an embodiment of the present invention, during the upside-down insertion of the pluggable module 20, the pair of insulating posts 118 prevent the surface 22*a* of the pluggable module 20 from simultaneously contacting two or more adjacent first solder contacts 124 of the first pins 120 and/or grounding one or more of the first solder tabs 124 and/or one or more of the first pins 120. Thus, the insulating ribs 116*a* and/or the insulating posts 118 prevent shorting contact during upside-down insertion of the pluggable module 20. Thus, the possibility of service interruption due to a short circuit resulting from upside-down insertion of the pluggable module may be effectively reduced.

In one embodiment of the invention, insulating ribs and the insulating posts are placed in positions that do not violate the SFP Transceiver Multi-Source Agreement (MSA), dated Sep. 14, 2000, hereby incorporated by reference in its entirety and solves the electrical effects of the undefined module insertion mechanical polarity of the MSA specification, while reducing the possibility of shorting between pins and/or grounding of one or more of the pins and/or one or more of the solder tabs during upside-down insertion of a pluggable module.

Additionally, the term "or" as used herein is generally intended to mean "and/or" unless otherwise indicated. Combinations of components or steps will also be considered as being noted, where terminology is foreseen as rendering the ability to separate or combine is unclear.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An apparatus comprising:

an insulating body, defining a slot and a plurality of pin channels, comprising a pair of posts respectively located at two lateral ends thereof, wherein an extending direction of the pair of posts is substantially parallel and opposite to an inserting direction of the slot;

a plurality of spacers alternatively arranged between the pin channels, wherein one of the spacers is located between two adjacent pin channels; and a plurality of pins respectively disposed in the pin channels, wherein each of the pins comprises a contact tab extending into the slot and a solder tab extending outwardly from an external side of the insulating body, the posts extending outwardly from the insulating body beyond the solder tabs, wherein each spacer comprises a rib extending beyond the external surface of the insulating body and said pair of posts protect the plurality of pins from being shorted by a pluggable module being inserted upside down.

2. The apparatus as claimed in claim 1, wherein the ribs are integrally formed with the spacers.

3. The apparatus as claimed in claim 1, wherein an extending direction of the ribs is substantially parallel and opposite to an inserting direction of the card slot.

4. The apparatus of claim 1, further comprising a second plurality of pin channels and a second plurality of conductive pins disposed in the second plurality of pin channels.

5. The apparatus of claim 1, wherein the plurality of pins is suitable for electrically connecting to a small form-factor pluggable (SFP) module.

6. An apparatus, comprising:

an insulating body defining a slot and a plurality of first pin channels;

a plurality of pins respectively disposed in the pin channels, wherein each of the pins comprises a contact tab extending into the slot and a solder tab extending outwardly from an external side of the insulating body; and a pair of posts extending outwardly from the insulating body beyond the solder tabs and in a direction substantially parallel to an inserting direction of the slot where said pair of posts protects the plurality of pins from being shorted by a pluggable module being inserted upside down.

7. The apparatus as claimed in claim 6, wherein the contact tab is adapted to slideably and conductively engage with a contact of a circuit card inserted into the slot.

8. The apparatus as claimed in claim 6 wherein the plurality of pins comprise a first pin and a second pin, wherein the first pin comprises a first contact tab extending from a first side of the slot, and the second pin comprises a second contact tab extending from a second side of the slot.

* * * * *